United States Patent [19]

Erzmoneit

[11] Patent Number: 4,524,969

[45] Date of Patent: Jun. 25, 1985

[54] BILLIARD APPARATUS HAVING SENSORS IN LIEU OF POCKETS

[76] Inventor: Horst Erzmoneit, Fredenbecker Strasse 36, 2741 Kutenholz, Fed. Rep. of Germany

[21] Appl. No.: 611,939

[22] Filed: May 21, 1984

Related U.S. Application Data

[63] Continuation of Ser. No. 416,179, Sep. 9, 1982, abandoned.

[30] Foreign Application Priority Data

Sep. 10, 1981 [DE] Fed. Rep. of Germany ..... 3135846

[51] Int. Cl.[3] ..... A63D 15/00

[52] U.S. Cl. ..... 273/3 R

[58] Field of Search ..... 273/2, 3 R, 3 A, 4 R, 273/4 A, 118 A, 119 A

[56] References Cited

U.S. PATENT DOCUMENTS

| | | | |
|---|---|---|---|
| 385,346 | 7/1888 | Flint | 273/3 R |
| 620,026 | 2/1899 | Fletcher | 273/2 |
| 2,229,295 | 1/1941 | Kocl | 273/118 A |
| 2,530,896 | 11/1950 | Metz . | |
| 2,610,277 | 9/1952 | Hooker et al. | 273/118 A X |
| 3,090,622 | 5/1963 | Sire | 273/118 A X |
| 3,448,459 | 6/1969 | Margolis | 273/2 X |
| 3,466,038 | 9/1969 | Hill | 273/14 |
| 3,945,639 | 3/1976 | Timmerman | 273/3 A |
| 4,325,551 | 4/1982 | Kulesza et al. | 273/118 A X |

FOREIGN PATENT DOCUMENTS

| | | |
|---|---|---|
| 3001924 | 7/1981 | Fed. Rep. of Germany . |
| 632532 | 1/1928 | France . |
| 786881 | 9/1935 | France . |
| 2381539 | 9/1978 | France . |
| 2473892 | 7/1981 | France . |
| 78556 | 5/1918 | Switzerland . |
| 2005552 | 4/1979 | United Kingdom . |

*Primary Examiner*—William H. Grieb

*Attorney, Agent, or Firm*—Andrus, Sceales, Starke & Sawall

[57] ABSTRACT

A billiard table has a playing area bordered by a cushion. The pockets found in a typical pool billiard table are replced by sensor fields disposed in the plane of the playing area having contactless sensors associated therewith responsive to the presence of a billiard ball. The output signals of the sensors are applied to a visual indicator.

26 Claims, 7 Drawing Figures

BILLIARD APPARATUS HAVING SENSORS IN LIEU OF POCKETS

This is a continuation of application Ser. No. 06/416,179, filed Sept. 9, 1982, now abandoned.

It is well known that a difference is made between two principal types of billiards, namely, the German or pool billiard and the French cannon billiard. The former has three pockets provided along each longitudinal side in the corners and center thereof, which are provided with ball catching means underneath, for the reception of balls. These balls, so-called object balls, are played with a cue ball. With cannon billiards, the billiard table which is usually covered with a green-cloth is designed as a smooth surface. It is also known to subdivide the playing area into fields by chalk lines in such a manner that only a certain number of cannons may be played in each of the fields (cadre billiards).

With the known billiard tables it is not possible to play all the various types of billiard games. Therefore, it is the object of the invention to provide a billiard playing apparatus which is capable of being used for cannon billiards, pool billiards and/or for cadre billiards.

In accordance with the invention, this object is attained in that the pockets are replaced by pocket fields disposed in the plane of the playing area, with a contactless initiator associated with them responsive to the presence of a billiard ball, the output signal of the contactless initiator being applied to an indicating device.

With the billiard apparatus in accordance with the invention, the pockets necessary for pool billiards are replaced by a corresponding marking on the playing field having initiators or sensors associated therewith which register the presence of a billiard ball in the neighbourhood of the marking on the field and transfer a corresponding output signal to an indicating device. In this manner the playing area may be readily used also for conventional cannon billiards or for cadre billiards.

Another advantage resides in that the dimensions of the playing area may be strongly reduced. The conventional pool billiard requires 16 balls of a predetermined diameter. In the case of the billiard apparatus according to the invention the object balls may be dispensed with, and all that is needed is the cue ball. At best, one object ball may additionally be employed in order to increase the degree of difficulty.

However, not only the dimensions of the playing area but also the geometry thereof may be changed. So, the playing area may be triangular in order to be suited for erection in a corner or together with like billiard apparatuses one against the other. In the case of a triangular playing area the cushions adapted to be against are formed in such a manner that each pocket field may be played to no matter where the cue ball may be. This may be obtained, for example with cushion portions curved towards the playing area.

As initiators or sensors, all proximity switches or the like that are generally used in the art are suited. Contactless initiators offer the advantage that they may be fitted on the underside of the billiard table, preferably in an underneath recess, such that the thickness of the table is considerably reduced in the area of the initiator. With this embodiment, preferably, capacitively or inductively operated initiators are to be taken into consideration. Preferably, in one embodiment of the invention, an inductor coil is used for the initiator, which forms part of an oscillation circuit. The ball then comprises electrically conductive or magnetically effective material or is completely made thereof, so that the entrance of the ball into the environment of the initiator will entail a damping of the oscillating circuit. This damping is detected electronically and will result in a signal for the indicating device.

It goes without saying that also other initiators, for example, those operating on an optical basis may be employed.

If the initiators are designed in such a manner that they are responsive in a different manner to different materials, it is advantageous according to another embodiment of the invention for the billiard balls to consist of different materials. For instance, the cue ball may consist of a material to which the initiator does not respond, while the object ball causes the initiator to become responsive. Furthermore, the object balls may consist of different materials and, accordingly, cause different signals of the initiator. Thereby, the individual object ball may be associated with a value which may be correspondingly indicated in the indicating device.

In addition to this possibility, the electronic circuit allows for the individual pool areas to be associated with different values or individual pool areas, respectively, to be additionally connected or switched off. Furthermore, the pool markings may be connected in such a manner that they must be played to in a certain timed sequence in order to obtain a maximum score.

Furthermore, the usual conditions for competition may be created by providing two readings and a reversing switch. The first player is allotted the pocket fields 1 to 7, while allotting the second player like pocket fields as 9 to 15, with the eighth pocket field being considered to be a neutral field for both players. The players thus will have to take care each time before starting that the reversing switch is in the proper position.

It is furthermore understood that additional obstacles may be associated with the billiard apparatus which may either be removable or installed in fixed positions. The obstacles are in turn provided with corresponding initiators which with the ball striking against the obstacles will generate an output signal for the indicating device.

For the operation of an electronic circuit arrangement for the billiard apparatus according to the invention it is advantageous according to another embodiment of the invention for the output signals of several initiators to be applied in parallel to a timing element, the output signal of which is likewise applied to the indicating device setting it. The timing element is, in turn, set with a first response from an initiator and will then be running for a given time which is slightly longer than the maximum running time of the ball after having struck upon a first marking. After the expiration of the set time, the indicating device is inactivated so that it is impossible or any false indications and false counts, respectively, to occur.

The possibility has already been mentioned to allot the individual balls different values. Alternatively, according to another embodiment of the invention, the possibility exists of the initiator being connectible to a stage of value associating each initiator signal to a value with the value signal being fed to a counting and indicating device via a computer stage. The value stage may be set ad libitum as to which value the signal of an initiator is to be allotted. A counter will then be triggered via the computer, which will then indicate the entire scored value in the known manner, for example, with the aid of a digital indication of figures. In the value stage, besides, a certain time sequence may also be set to predetermine the sequence in which the individual pool fields or other markings have to be played for.

According to another embodiment of the invention, provision is made for the individual initiators to be respectively connectible to a separate indicating device, in which the indicating means may, however, be arranged in the same configuration as the pocket fields on the billiard table. So, each initiator may have associated thereto a small indicator lamp, for example, which lights up and becomes extinct again when the associated initiator is actuated by a ball. The object to be aimed at in the play may be to actuate the individual initiators with a minimum number of strokes. To actuate the individual initiators in a certain timed sequence means renders this more difficult. Finally, in accordance with another embodiment of the invention, provision is made for the separate indicating means to be adapted to be triggered by a random generator, with a selector key being provided by means of which the selection of an indicating means is randomly retained. The random generator triggers cyclically the individual indicating means, and it is up to the player to retain ad libitum a desired indication. The player will strive respectively to retain that indication which is most favourable for the respective situation in the play, i.e. which field and which marking, respectively, is most favourable to play for.

According to another embodiment of the invention, provision is made for a second timing stage to be provided which is to be connected to the indicating device and, which, upon the expiration of a predetermined period of time after it has become responsive for the first time inactivates the indicating device. This timing stage may be important in case the billiard apparatus according to the invention is used commercially. While, with a pool billiard apparatus. a time limit is automatically set to the play by the disappearance of the balls in the pockets, this is not the case with the billiard apparatus according to the invention. Here, the timing stage takes care of a positive termination of the play. If the billiard apparatus according to the invention is employed only as a pool billiard, the neutral field may be designed to be a pocket, so as to end the play after playing up to the neutral field.

An example of embodiment of the invention will be described in the following in more detail by way of drawings.

Figure 1:
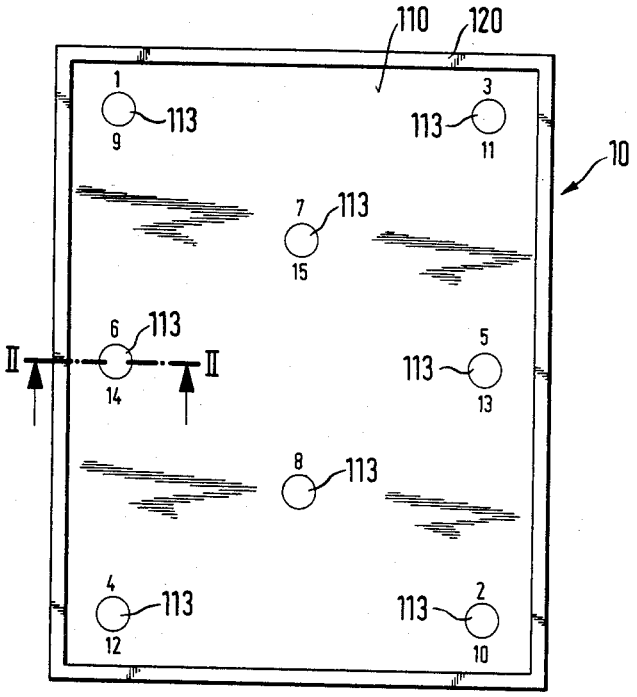
FIG. 1 shows a top plan view of a diagrammatic representation of the billiard apparatus according to the invention.

Prior to enlarging in more detail on the individual embodiment shown in the drawings it is to be stated that each of the features shown and described is of inventively essential importance by itself or in connection with features of the claims.

FIG. 1 shows diagrammatically a billiard apparatus 10 comprising a rectangular billiard table or playing area 110 surrounded by a cushion 120. On the playing area 110 one will recognize eight circular markings 113 six of which arranged at the edge corresponding to the pockets of a conventional pool billiard apparatus. The two pocket fields arranged on the longitudinal center line are provided additionally, in that one (No. 8) of them corresponds to the neutral and the other to a conventional object ball. While with normal pool billiards, pockets are provided, in the case of the billiard apparatus according to FIG. 1, the marks 113 are designed only to be plane, which thus do not influence the playing path of a ball.

Adjacent to the markings 113, the billiard table 110 is provided with recesses 114 at the underside thereof and an induction coil 115 arranged therein and fastened in a suitable manner. The billiard table preferably consists of a material which is magnetically ineffective and, therefore, does not influence the field 116 of the induction coil 115. A billiard ball 117 of an electrically conductive or magnetically effective material will influence the field 116 when it enters the region of the marking. This act of influencing may be converted into an initiator or sensor signal by an electronic circuit.

The billiard apparatus according to FIG. 1 may be played with only one cue ball which activates the initiators. Object balls as are necessary in connection with the conventional pool billiard may be dispensed with. Therefore, the dimension of the playing area 110 may be considerably reduced.

In the example of the embodiment according to FIG. 1, only the position of the pockets of a pool billiard is marked. It goes without saying that also other markings and obstacles may be provided which may be equipped in a similar manner with an initiator as diagrammatically shown in FIG. 2.

Figure 2:
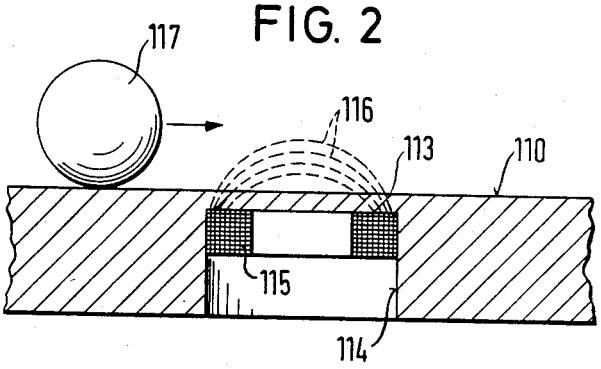
FIG. 2 shows a sectional view taken on line 2—2 of FIG. 1.
Figure 3:
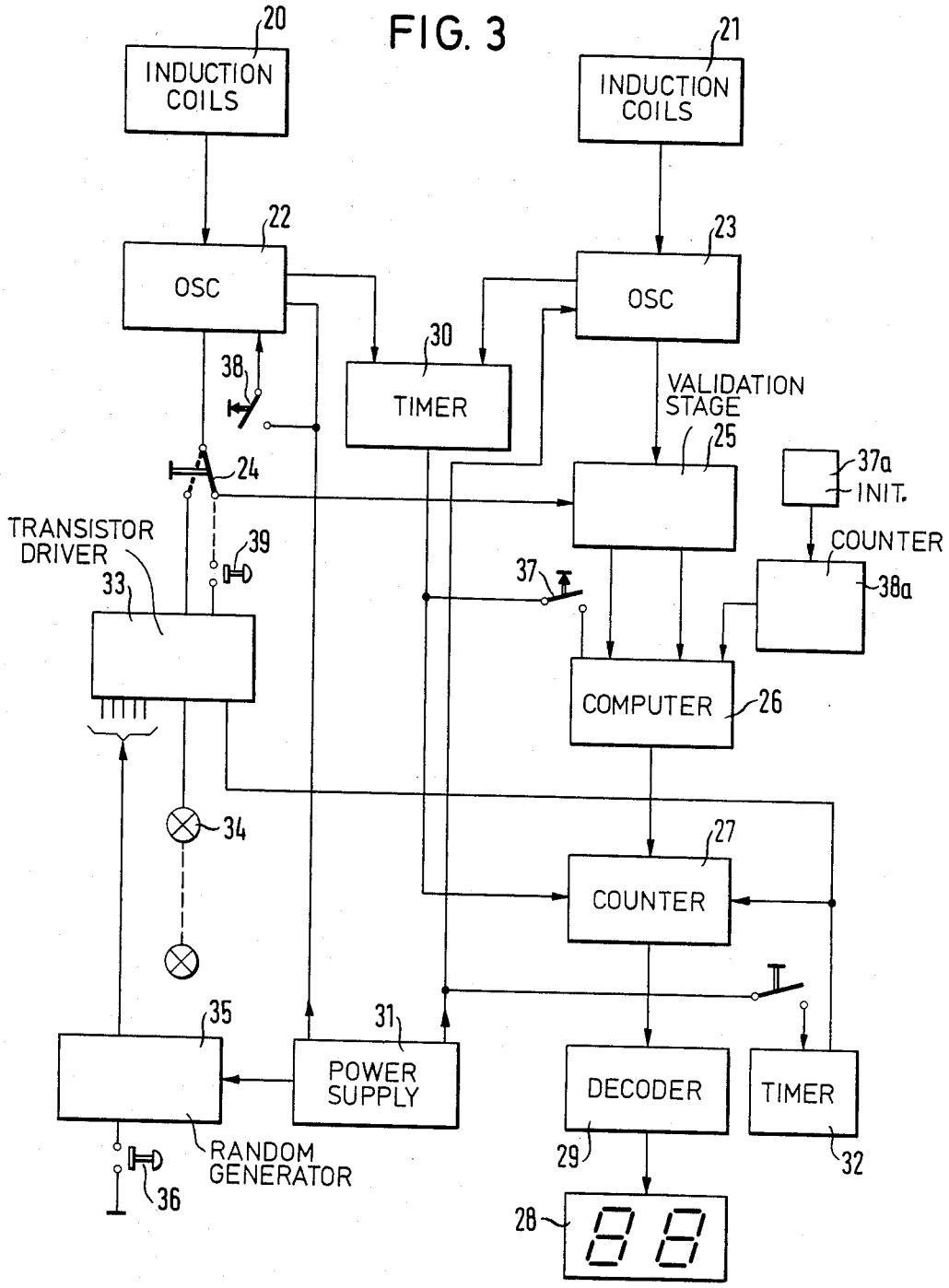
FIG. 3 shows by way of example an electronic circuit for a billiard according to the FIGS. 1 and 2.

FIG. 3 shows by way of example a circuit arrangement for a billiard apparatus according to FIGS. 1 and 2.

The stages 20 and 21 show contactless initiators or sensors similar to the induction coil 15. It goes without saying that in the case of the embodiment according to FIG. 1, six such initiators will have to be provided. The induction coils 20, 21 cooperate with oscillating circuits 22 and 23, respectively.

The entrance of a correspondingly acting billiard ball into the sensing range of an initiator results in a corresponding damping of the oscillation circuit 22 and 23, respectively, from which an initiator signal may be derived in a manner known per se. In the case of the initiator 20 the initiator signal passes over a switch 24 onto a value stage 25. In the case of the initiator 21 the value stage 25 is directly triggered. In the value stage the oncoming initiator signal may have associated thereto a certain value ad libitum, in order to provide the respective markings to be played for or being played for with a different degree of difficulty. In the value stage 25, furthermore, a timing sequence may be predetermined in which the individual initiator signals have to occur so as to be valued. Thereby, it is possible, for example, to increase the degree of difficulty of a pool billiard game.

The value signals coming from the value stage 25 are summed up in the computer 26 and counted in the counter 27 which is connected to the computer 26, and indicated by a digital indication 28 which is connected to the counter via a decoder 29.

The oscillating circuits 22, 23 also have a timing stage 30 connected thereto. If an initiator 20 or 21 becomes responsive, the timing member 30 will be contacted and will set the counter 27. After the expiration of the time set ad libitum in the timing member 30, the counter 27 will be inactivated. The time to be set in the timing member 30 is slightly longer than the maximum time needed by a ball being played after having activated a first initiator.

A power supply unit 31 supplies the individual stages with energy in the manner as shown. Alternatively, battery supply may also be provided.

Another timing stage 32 serves to set the playing time. After the expiration of the playing time, the counter 27 which is connected to the timing stage 32 is inactivated.

Individual signal lamps 34 may be triggered via a transistor stage 33 (extremely schematical representation). Each signal lamp 34 belongs to a certain marking or to a certain field, such as the fields 13, for example, of the billiard apparatus according to FIG. 1. FIG. 3 only shows the triggering of the transistor stage 33 via the induction coil 20, the oscillating circuit 22 and the switch 24. It goes without saying that all the initiators belonging to a billiard apparatus may trigger the transistor stage 33. If an initiator is activated by a ball, the associated signal lamp 34 will light up or—vice versa—will be switched off. In this manner, the individual markings, fields or the like may be indicated on the billiard table.

The object aimed at in the game may be to play individually for the individual fields and in a predetermined sequence, respectively. The signal lamps 34 indicate whether this object is attained.

Finally, a random generator 35 is provided which is connected to the transistor stage 33. With the aid of the random generator 35 the individual signal lamps 34 are cyclically triggered one after the other, with the sequence, however, being at random. With the aid of the keyswitch 36 the player may try, upon the signal lamp desired by him lighting up, to "retain" the latter. This is advantageous in cases when the respective situation in the play makes the playing for the associated field appear to be particularly favourable.

With the aid of a switch 38 the signal lamps 34 may be extinguished. With the aid of a switch 37 the indication of the digital indicating device 28 may be extinguished.

According to another embodiment of the invention the cushion of the billiard also is designed in such a manner that a stroke applied to a ball will result in a signal capable of being evaluated. For this purpose, several initiators are associated with the cushion. These may react to pressure or impact, for example, but may also work electrooptically. In the circuit diagram according to FIG. 3 such an initiator or the plurality of initiators, respectively, is designated with 37*a*. The initiator 37*a* is connected to a further counter 38*a*, which may be set to a certain number of pulses. With the features as described, a cushion play may be predetermined such as a three-cushion play, for example, the ball must first hit the cushion thrice and then hit a goal. The counter 38*a* will then establish whether the three-times contact of the cushion has been fulfilled. Only thereafter will an output signal be applied to the computer 26 which will then perform the evaluation of the play in the manner as described above.

The individual indicating lamps 34 which are associated with each pool are, besides, provided with a keyswitch 39 of their own, only one of them being shown, however, in FIG. 3. With the aid of the keyswitches 39 one or several indications 34 may be selected, so that the corresponding fields or pools are being selected that are to be played off by the player. The connection via the value stage 25 to the computer 26 is such that the computer 26 only registers the selected pool markings, suppressing the remaining ones.

Figure 4:
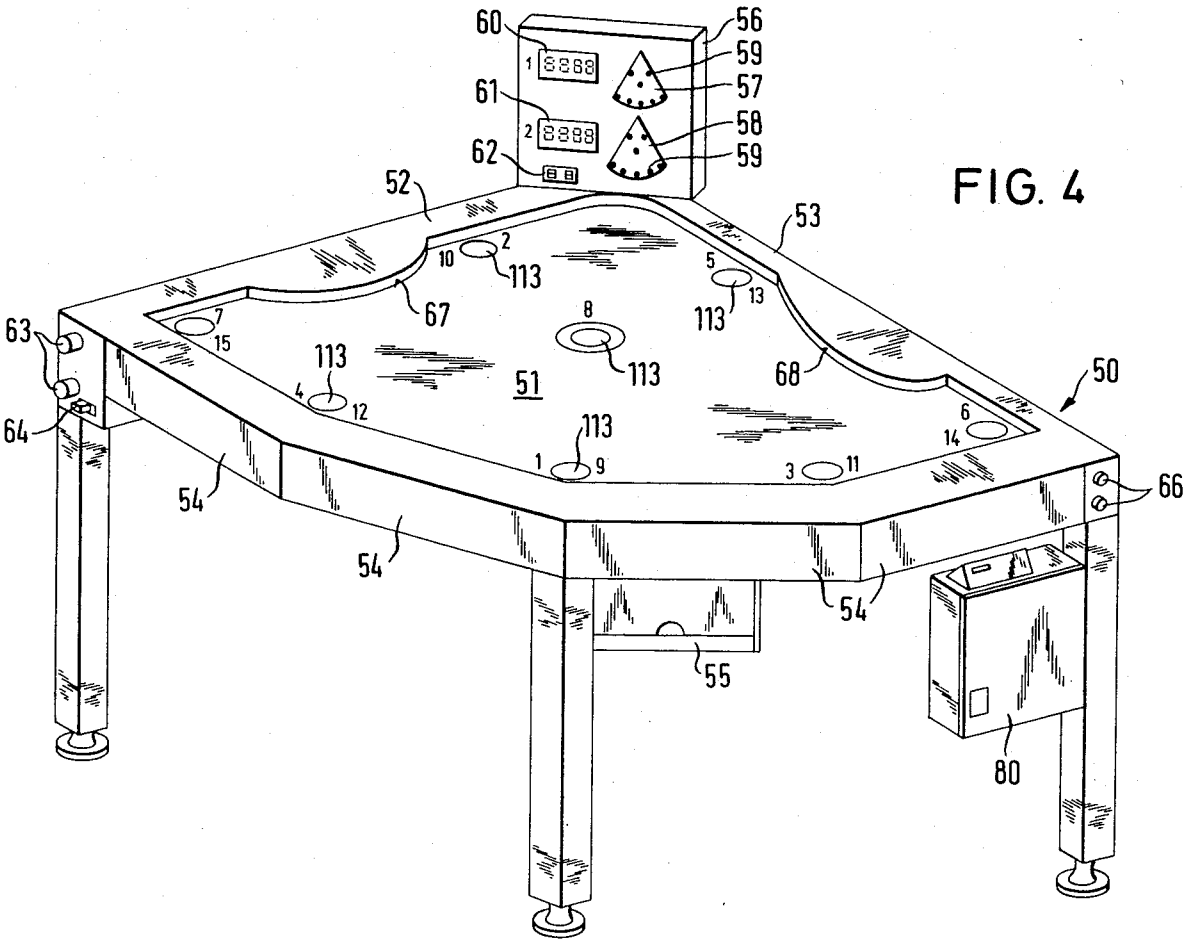
FIG. 4 shows a perspective view of a triangular pool billiard apparatus according to the invention.

In FIG. 4, a billiard table 50 is shown in a perspective view the playing area 51 of which is approximately triangular. Two cushions 52, 53 are extending towards each other at right angles. At the other ends, they are connected to each other by four equally long straight cushion portions 54.

The outer cushion portions 54 include a right angle with the cushions 52 and 53, respectively, while the remaining cushion portions 54 include between them an obtuse angle. Eight pocket fields 113 are arranged along the cushions 52 to 54. Five pocket fields 113 are associated with the apices, as will be seen from FIG. 4, while two of them are arranged between the ends of the cushions 52 and 53, respectively, and a third pocket field is disposed approximately in the center. The center pocket field, in contrast to the other pocket fields, is designed to be deepened, while the remaining ones, as also is the case with the example of embodiment according to FIG. 1, are disposed in the plane of the playing area. They are also respectively interrelated with an initiator in the same manner as in FIG. 1. Same as is the case with the example of embodiment according to FIG. 1, two figures are respectively associated with the pocket fields at the edge, with one figure respectively associated with one player of the game and the second figure being with the second player of the game. The center pocket bearing the number 8 is deepened and corresponds to the neutral ball in the case of a conventional pool billiards, which is to be played last. If the field No. 8 is played for, the cue ball which is the only one being used, will drop into the table and may be taken away from the table again at 55 only after insertion of a coin into a coin actuating mechanism 80.

At the apex of the cushions 52 and 53 an indicating cabinet 56 is arranged, which comprises two visual indicators 57 and 58, respectively, with small lamps 59. The visual indication corresponds to the configuration of the playing area 51, with the small lamps 59 corresponding to the pocket fields 113. Furthermore, the indicating cabinet 56 comprises two digital indicators of FIGS. 60 and 61, respectively, as well as a reception figure indicator 62. Pressure switches 63 serve to activate the respective indicators 57 or 58. The digital indicator 60, 61 may likewise be switched on alternatively. A reversing switch 64 takes care that either the series 1 to 7 or 9 to 15 are respectively played by the first and second players. In this manner, the pool billiard may be played in the conventional manner. The switches 66 serve to extinguish the visual indicators 57 and 58.

The electronic pool billiard table shown in FIG. 4 may be placed in the corner of a room, so that it can be played only from the cushion portions 54. The same holds equally true in case several, for example, four billiard tables of the type as shown in FIG. 4 are to be assembled in a group. In that case care must be taken that all the pocket fields 113 may be reached from the playable side either by a direct stroke or by contacting the cushion. In order to improve on the playing for the individual pocket fields 113, the cushions 52 and 53 are provided with cushion portions 67, 68 which are convexly curved towards the playing area 51.

Figure 5:
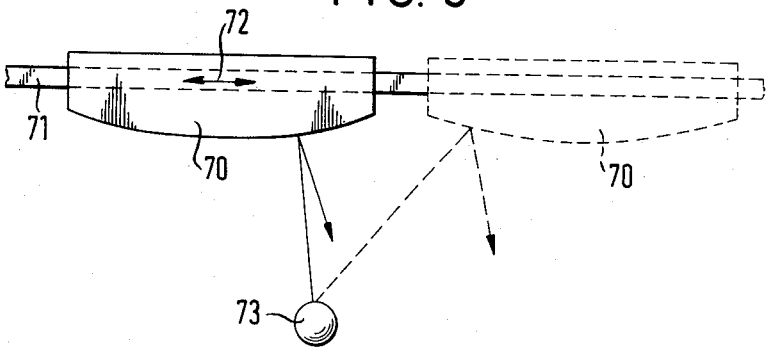
FIGS. 5 to 7 show various possibilities of an adjustable cushion.

In FIG. 5, a cushion portion 70 is shown diagrammatically which is supported for adjustment along a guide 71 and is capable of displacement in either direction as indicated by the double arrow 72. A displaced position is indicated in dashed lines. A billiard ball 73 may be played according to the dashed lines against the cushion portion 70, and reflected. The cushion portion shown in FIG. 5 may correspond, for example, to the cushion portions 67 and 68, respectively, according to FIG. 4.

Figure 6:
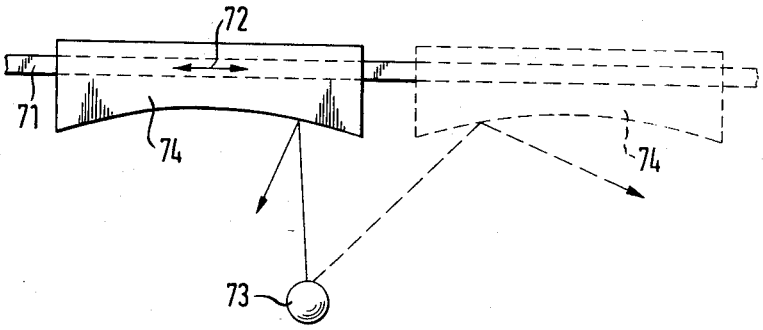

FIG. 6 shows a concavely curved cushion portion 74, which is again capable of adjustment along a guide 71.

Figure 7:
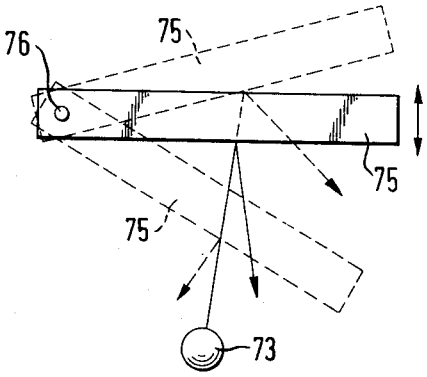

FIG. 7 shows a lever type cushion portion 75 which is pivotally supported at 76 at its one end so as to make possible a different reflection of the ball 73 being played.

It goes without saying that a logic circuit may be interposed between the initiators or sensors associated with the individual pocket fields 113 and the indicating device, said logic circuit making possible different evaluations of the signals of the initiators. An interrelation may be effected in such a manner that points of the pool, for example, played for anew by the first player may be credited to the opponent.

Instead of the indicating device separately indicating the hits, the initiators associated with the playing fields or pocket fields may directly effect an indication of hits by themselves. The same is equally applicable to initiators associated with the cushion. The indication initiators may be mechanical elements, for instance, flaps or levers. They may also react to pressure or optically, in order to indicate to the player that a hit has been scored.

Such a pool billiard apparatus may yet be played as in cannon billiards because a smooth playing area is still available. In the case of a direct indication of hits of the type as outlined above, however, 15 pocket fields must be provided in connection with the pool billiard apparatus, i.e. 1 to 7 for the first player and 9 to 15 for the second player, respectively, and one pocket field (No. 8) as a neutral field. The latter may also be provided with a pocket, in order to have the cue ball disappear. It goes without saying that the last mentioned embodiment too may be played with a cue ball only, without an object ball.

I claim:

1. A billiard apparatus comprising: a planar playing area (110, 51), a cushion (120, 52, 53, 54) bordering said playing area, a plurality of pocket fields (113) positioned adjacent said cushion; and least one playing field (113) positioned in the interior of said playing area, said pocket fields and playing field being disposed in the plane of the playing area and each having a contactless sensor (115) associated therewith responsive to the presence of a billiard ball, said sensors being coupled to a visual indicator device (56).

2. A billiard apparatus according to claim 1 having a rectangular playing area with long and short cushions bordering said area, pocket fields positioned in the corners of said area and at the centers of the long cushions, and a pair of spaced playing fields located on a longitudinal center line of the playing area parallel to the long cushions.

3. A billiard apparatus according to claim 1 having a generally triangular playing area (51), and wherein a playing field is arranged generally in the center of said playing area.

4. A billiard apparatus according to claim 3 wherein the center playing field is recessed.

5. A billiard apparatus according to claim 3 wherein one of the cushions bordering the generally triangular playing area is formed of a plurality of straight partial cushion members (54) arranged at an obtuse angle with respect to each other and wherein the playing area is formed so that the cushions, so formed, border the playing area.

6. A billiard apparatus according to claim 4 wherein one of the cushions bordering the generally triangular playing area is formed of a plurality of straight partial cushion members (54) arranged at an obtuse angle with respect to each other and wherein the playing area is formed so that the cushions, so formed, border the playing area.

7. A billiard apparatus according to claim 3 wherein the cushion has a pair of adjacent cushions (52, 53) having arcuate portions (67, 68) extending into the playing area (51).

8. A billiard apparatus according to claim 7 wherein said arcuate portions (67, 68) have at least one of a convex or concave curvature.

9. A billiard apparatus according to claim 7 wherein said cushion portions are displaceable along the cushion.

10. A billiard apparatus according to claim 8 wherein said cushion portions are displaceable along the cushion.

11. A billiard apparatus according to claim 3 wherein the visual indicator apparatus (56) is arranged at an apex of the generally triangular playing surface.

12. A billiard apparatus according to claim 1 wherein said visual indicator device (56) includes lamps (59) representing the sensors in the playing area.

13. A billiard apparatus according to claim 12 wherein said visual indicator device (56) further includes a digital scoring indicator (61, 62).

14. A billiard apparatus according to claim 12 wherein said playing area representation and digital indicator are provided in duplicate and wherein said indicator device includes a switch (64) for selecting desired ones of the representation and digital indication.

15. A billiard apparatus according to claim 13 wherein said playing are a representation and digital indicator are provide in duplicate and wherein said indicator device includes a switch (64) for selected desired ones of the representation and digital indication.

16. A billiard apparatus according to claim 1 wherein said sensor (115) includes an induction coil (20, 21) forming a portion of an oscillator circuit.

17. A billiard apparatus according to claim 16 wherein said sensor is arranged below the plane of the playing area.

18. A billiard apparatus according to claim 1 wherein said sensor is arranged below the plane of the playing area.

19. A billiard apparatus according to claim 1 wherein said billiard balls are formed of different materials to which said sensors are selectively responsive.

20. A billiard apparatus according to claim 1 wherein the outputs of said sensors (22, 23) are applied in parallel to a timing circuit (30), the output of which is coupled to said visual indicator device (56).

21. A billiard apparatus according to claim 20 wherein said sensors are connected to a value circuit (25) for applying a value to said sensor signals, said value circuit (25) being coupled to a counting and indicating device (27, 28, and 29) for said visual indicator.

22. A billiard apparatus according to claim 1 wherein individual sensors are coupled to separate indicators (34) in said visual indicator device (56).

23. A billiard apparatus according to claim 22 wherein said separate indicators are adapted to be selectively triggered by a random generator (35) coupled thereto, and including a selector switch (36) for retaining a triggering of the indicator (34).

24. A billiard apparatus according to claim 22 including a timer coupled to said indicators for providing a predetermined period of responsiveness to the sensor and indicator.

25. A billiard apparatus according to claim 22, wherein each of said indicators (34) has a separate switch (39) associated therewith for controlling the operation of said indicator.

26. A billiard apparatus according to claim 1 wherein said cushion has at least one sensor (37*a*) associated therewith and providing a signal responsive to impact by a ball, said sensor (37*a*) being connected to a counting means adapted to be set to a predetermined number of counts and issuing an output signal only upon receipt of said predetermined number of counts from a sensor (37*a*).

* * * * *